US006769863B1

(12) United States Patent
Carlberg et al.

(10) Patent No.: US 6,769,863 B1
(45) Date of Patent: Aug. 3, 2004

(54) METHOD AND APPARATUS FOR HANDLING LIGHTWEIGHT STRIPS

(75) Inventors: David L. Carlberg, Sonora, CA (US); Dennis May, Sonara, CA (US); Theodore V. Meigs, Sonora, CA (US)

(73) Assignee: Kinematic Automations, Inc., Sonora, CA (US)

( * ) Notice: Subject to any disclaimer, the term of this patent is extended or adjusted under 35 U.S.C. 154(b) by 49 days.

(21) Appl. No.: 10/269,008

(22) Filed: Oct. 9, 2002

(51) Int. Cl.[7] ..... B65G 59/00
(52) U.S. Cl. ..... 414/796; 414/798.9; 414/797
(58) Field of Search ..... 414/796, 798.9, 414/798.3, 795.6, 796.2, 797

(56) References Cited

U.S. PATENT DOCUMENTS 4,965,983 A * 10/1990 Muller et al. ..... 53/435
5,067,309 A * 11/1991 Carlberg et al. ..... 53/520
5,333,985 A * 8/1994 Schmeisser et al. ..... 414/790.3
5,816,030 A * 10/1998 Carlberg et al. ..... 53/520
6,089,000 A * 7/2000 Carlberg et al. ..... 53/443
6,557,446 B2 * 5/2003 Carlberg et al. ..... 83/102

* cited by examiner

*Primary Examiner*—Douglas Hess
(74) *Attorney, Agent, or Firm*—Harris Zimmerman

(57) ABSTRACT

Apparatus and method for manipulating lightweight strips in parallel, laterally edge-adjacent array into spaced apart array for processing includes a platen having channels for receiving the strips, and a comb device for translating the strips of alternating channels to form two groups of laterally spaced strips. A pick-and-place conveyor has suction cups to remove each group in unison from the platen and place it on a belt conveyor. Suction holes in the channels selectively retain the groups on the platen. The comb, pick-and-place conveyor, and belt conveyor operate in synchrony and reiteratively to create a continuous stream of spaced apart strips.

25 Claims, 14 Drawing Sheets

METHOD AND APPARATUS FOR HANDLING LIGHTWEIGHT STRIPS

BACKGROUND OF THE INVENTION

The present invention relates to the formation, handling, and application of lightweight strips, such as, but not limited to, medical test strips. Many medical, chemical and biological diagnostic tests and assays for laboratory and home use have been reduced to an optimally simple routine: immerse a test strip or stick into a liquid, and observe the change in color of the test strip or stick to read the results of the test. Tests that formerly required days of laboratory work may now be carried out in seconds, with a reliability factor that exceeds former, more time-consuming methods. Generally speaking, the strips or sticks (hereinafter, "strips") comprise long, narrow pieces of paper, plastic, laminates, or similar thin sheet material that carry one or more highly specific reagent, reactant, or assay compound distributed in the sheet material.

The sheet material may be manufactured in large amounts, generally as long webs of the sheet material wound on spools to form a compact roll. The roll is fabricated into the test strips by first cutting the web into discrete lengths, or cards, that are subsequently fed into a strip cutting machine. The strips thus formed are then manipulated, gathered, and packaged as is known in the prior art. For example, U.S. Pat. No. 5,057,309 describes an apparatus for cutting and assembling batches of diagnostic strips, and U.S. Pat. No. 5,816,030 describes a scoop assembly for gathering strips from a platen that receives the strips formed by a rotary knife assembly. Likewise, U.S. Pat. No. 6,089,000 depicts a strip handling assembly in which strips are formed by cutter assembly and then placed on an accumulator track, from which a variable, programmable number of strips may be removed and packaged.

For some uses, the strips discharged from a cutter assembly are not gathered and packaged; rather, it is necessary to handle each strip individually to place each strip in an device, such as, for example, a pregnancy test kit, or the like. Due to the low ratio of mass to surface area of individual strips, the strips can be extremely difficult to manipulate (grasp, translate, apply, etc.) separately. In addition, the materials from which the strips are formed (such as paper stock, thin plastic web, etc.) may easily accumulate static electricity charges. The effect of static electricity on the low mass, high surface area strips may greatly exceed gravitational force. Likewise, stray air currents can disrupt any well-designed handling machinery.

It may be noted that the strips typically are discharged from a rotary cutting assembly in parallel, closely spaced array, the spacing being no greater than the thickness of the rotary knives that cut each card into strips. It is difficult to handle individual strips when they are spaced so closely together. Thus the strips must be separated and spaced apart to permit access by automated machines that carry out manipulation of the individual strips.

SUMMARY OF THE INVENTION

The present invention generally comprises an apparatus for forming, separating, and manipulating individual test strips and the like, whereby the individual strips may be applied or installed as required for any finished product.

The apparatus includes a rotary cutting assembly having a plurality of rotary knives that convert a card into a plurality of closely spaced strips; i.e., virtually no lateral spacing between the strips. The strips are delivered onto a platen assembly which is provided with a plurality of parallel channels, each channel having a bottom surface that is inclined laterally (with respect to the longitudinal extent of the respective strip). The channels have a proximal portion where the strips are received from the cutting assembly. The bottom surface of the proximal portion of each channel is provided with a pair of vacuum suction holes to maintain strips thereat. Among the plurality of channels in the platen, every other channel (hereinafter, a T channel) is designed for translation of a strip therein from the proximal portion to a distal portion. Each T channel distal portion includes a pair of holes in the bottom surface through which vacuum suction is applied to retain the strips in their respective channels. Each T channel proximal portion includes in the bottom surface thereof a longitudinally extending slot.

The apparatus further includes a separator assembly that extends laterally to span all the channels of the platen assembly, and is adapted to be translated longitudinally and reciprocally between positions that are superjacent to the proximal and distal portions of the platen assembly. The separator assembly includes an upper containment plate having a bottom surface that is formed in generally complementary fashion to the channels of the platen assembly, and is spaced vertically therefrom a sufficient distance to define a narrow vertical space in each channel that receives in the proximal portion thereof a respective strip from the cutting assembly.

The separator assembly also includes a comb device, which is pivotally secured to the separator assembly at a distal edge thereof. The laterally extending proximal edge of the comb device supports a plurality of tines extending downwardly and dimensioned to be received in a respective T channel of the platen assembly. The comb device is driven reciprocally to rotate from an upper position in which the tines are clear of the T channels, to a lower position in which the tines are engaged in the T channels. Indeed, in the lower position each tine is sufficiently long and narrow to extend into the respective slot formed in the bottom surface of the proximal portion of each T channel.

In general, the separator assembly is driven to translate to the proximal position of the platen assembly. With the comb device rotated to the upper position, the cutter assembly is operated to discharge a plurality of strips into all the channels, the strips being received in the narrow vertical space between the channels and the upper containment plate. At this stage, all the proximal portions of all the channels are filled with strips in a parallel array. Vacuum is applied to the holes in the bottoms of the proximal portions to retain the strips in place. The comb device is then rotated to the lower position, in which each tine is received in a respective slot of a respective T channel, the tine being closely spaced to the proximal end of the respective strip. Thereafter, the separator assembly is translated to the distal portion of the platen assembly, as the vacuum suction is released at the proximal portions of the T channels. The tines push the strips in the T channels distally, so that every other strip of the plurality is urged to the distal portion of the platen assembly. Suction is then applied to the holes in the bottom surfaces of the distal portions of the T channels to retain the strips thereat. At this stage the plurality of strips has been divided into two groups: a proximal group situated in every other channel of the proximal portion of the platen assembly, and a distal group disposed in the distal portions of the T channels. The proximal group is exposed in the channels, while the distal group is obscured by the presence of the separator assembly thereat.

Another major component of the invention is a pick-and-place conveyor assembly disposed adjacent to the platen assembly. The pick-and-place conveyor includes a pickup head that is adapted to translate reciprocally between positions superjacent to the platen assembly and to a belt conveyor. The pickup head is provided with a plurality of suction cups connected to a vacuum source, the suction cups arranged in two parallel lines, with a paired relationship therebetween. Each pair of suction cups are disposed each to engage an opposed end of one strip. The pairs of suction cups are arrayed in downwardly pointing orientation, and spaced so that each pair engages one of the strips in the proximal group or distal group; that is, spaced apart a distance equal to two channel widths.

The pick-and-place conveyor is driven reciprocally between a position superjacent to a belt conveyor, and, alternately, superjacent to the proximal and distal portions of the platen assembly. The pick-and-place conveyor is actuated in synchronism with the separator assembly and the cutter assembly.

In general, the invention operates according to the following sequential steps to achieve the goal of increasing the spacing of the lightweight strips so that the strips may be accessed and engaged by further processing equipment. When the separator assembly is disposed at the proximal portion of the platen assembly, and the comb is rotated upwardly, the separator assembly may be resupplied with strips from the cutter assembly, one strip in each and every channel. At the same time, the pick-and-place conveyor translates to the distal portion of the platen assembly, and descends to grasp each of the strips disposed in the T channels. The pick-and-place conveyor then retracts vertically, and translates to a position superjacent to a belt conveyor. At the belt, conveyor, the pick-and-place conveyor descends so that the suction cups are disposed at the surface of the belt conveyor, and the suction is cut off to release the strips onto the belt conveyor.

While the pick-and-place conveyor is translated away from the proximal portion of the platen assembly, the comb is rotated to the lower position, and the separator assembly is translated longitudinally to push the strips in the T channels to the distal portion of the platen. The proximal group of strips, in the non-T channels, are exposed upwardly, and the pick-and-place conveyor is translated to the proximal portion of the platen to pick up the proximal group. The pickup head is indexed laterally a distance equal to the width of one channel, so that the suction cup array is in registration with the proximal group of strips in the non-T channels.

After the pick-and-place conveyor grasps and lifts the proximal strips, it is translated toward the belt conveyor. After the pick-and-place conveyor clears the proximal portion of the platen assembly, the separator assembly is translated to the proximal portion of the platen, and vacuum suction is applied to the distal portions of the T channels to hold the distal group strips therein. This distal group is thus exposed upwardly for access by the pick-and-place conveyor, which then may begin another cycle.

It is significant to note that the strips, when placed onto the belt conveyor, are spaced apart longitudinally a distance equal to the width of one channel on the platen. This spacing enables access to individual strips on the belt conveyor by further processing equipment. The pace of each cycle of the invention may be bounded by extrinsic factors. For example, the belt conveyor must move a sufficient distance for the pick-and-place conveyor to deposit each array of strips onto the belt, so that the reciprocal movement of the pick-and-place conveyor may limit the operational speed of the combined mechanisms of the invention.

DESCRIPTION OF THE PREFERRED EMBODIMENT

Figure 1:
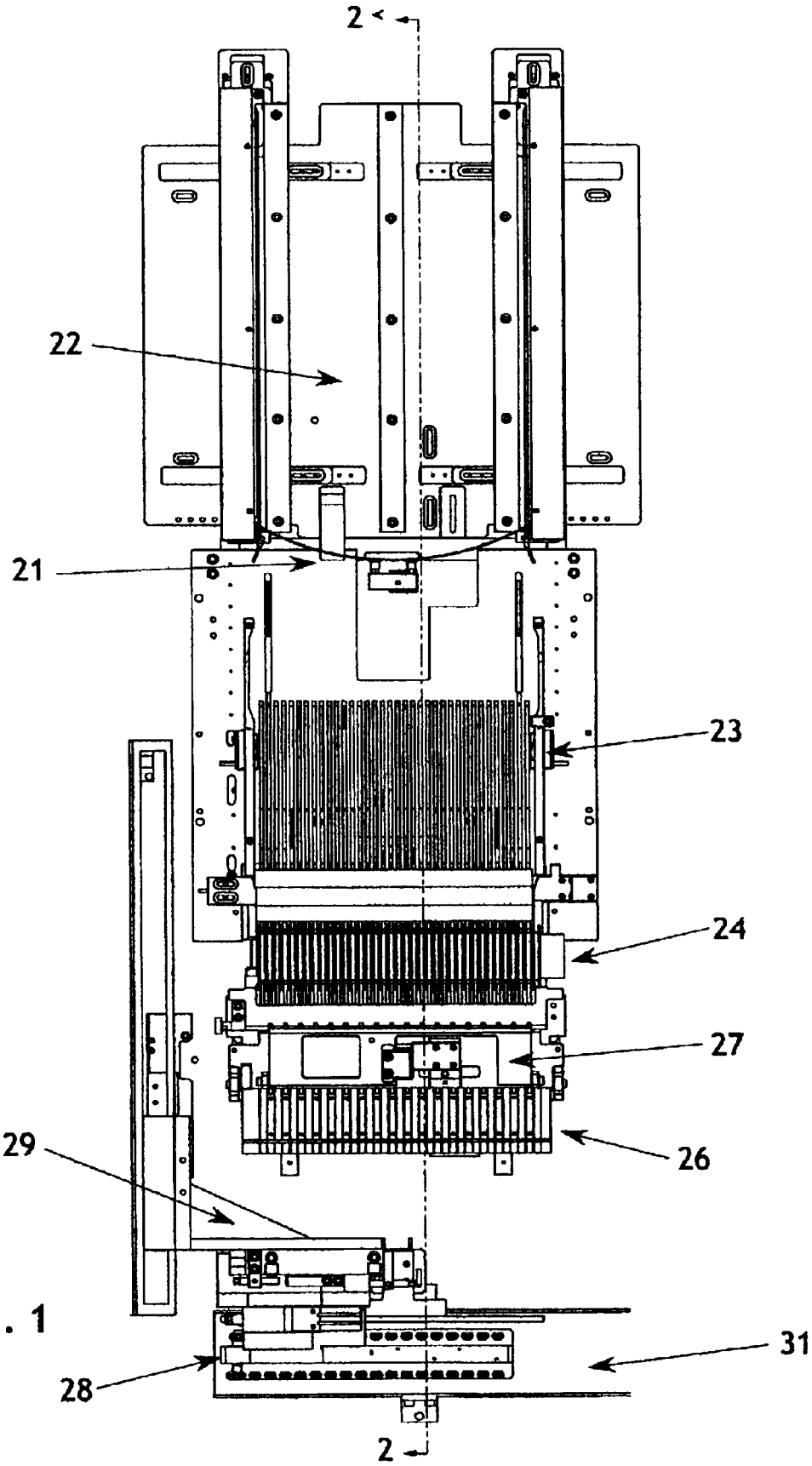
FIG. 1 is a plan view of the apparatus of the invention for cutting, separating, and delivering a plurality of lightweight strips.
Figure 2:
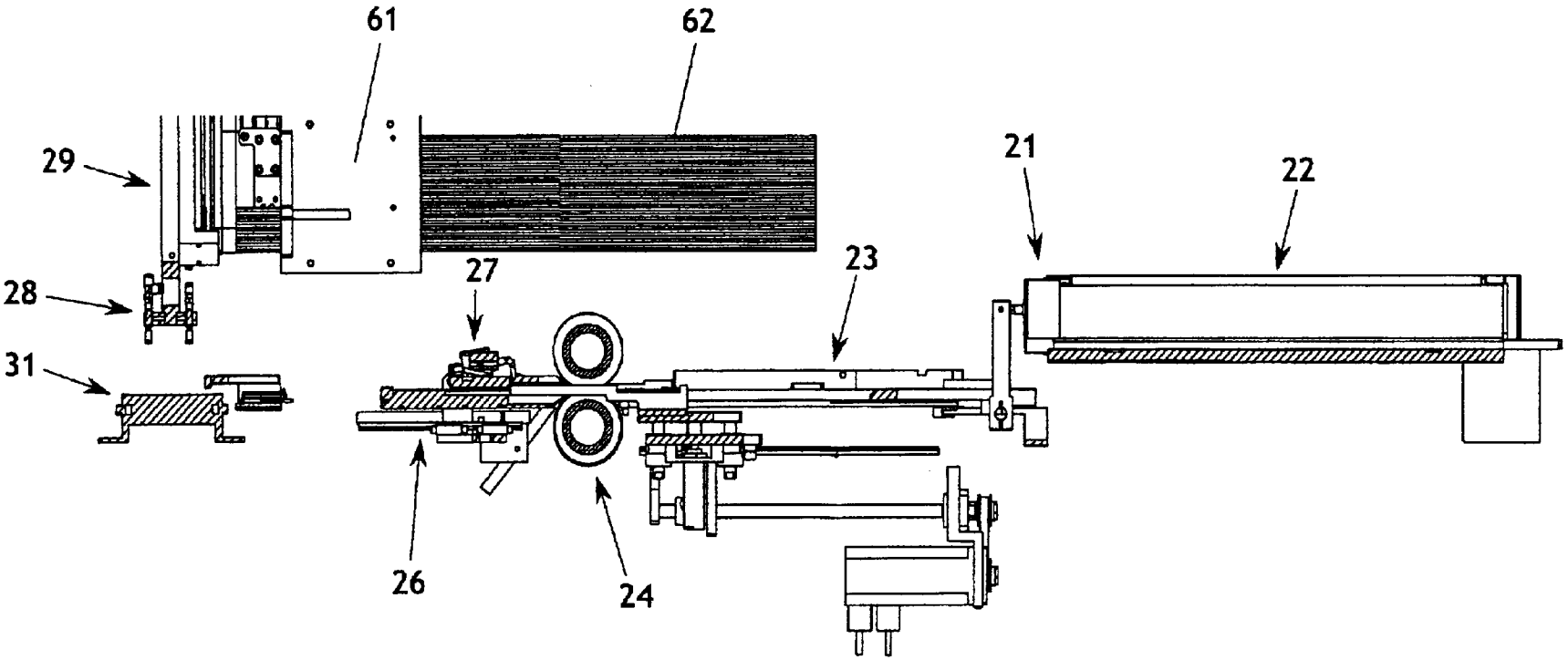
FIG. 2 is a side elevation of the apparatus generally depicted in FIG. 1, taken along line 2—2 of FIG. 1.

The present invention generally comprises an apparatus for forming, separating, and manipulating individual test strips and the like, whereby the individual strips may be applied or installed as required for any finished product The apparatus includes several major assemblies that are designed to be actuated in synchronized, cooperative manner that enables efficient, cost-effective production and handling of lightweight strips from raw materials such as card stock. With regard to FIGS. 1 and 2, the major assemblies include a card feeder device 21 that selectively feeds cards from a horizontal stack arrangement 22 to the intake platen 23 of a rotary knife cutter assembly 24. These assemblies are generally known in the prior art, and need not be discussed in detail herein. The strips are discharged from the cutter assembly 24 to an output platen assembly 26, and a separator assembly 27 sequesters the strips into two groups, each comprised of strips that are spatially separated. Thereafter, the pickup head 28 of a pick-and-place conveyor assembly 29 is operated to engage each group of spaced apart strips and transfer it to a belt conveyor assembly 31, where the strips are placed in a spaced apart disposition with respect to the longitudinal motion of the belt conveyor. The strips are thus disposed with sufficient spacing to undergo further processing steps by automated equipment with relative ease.

With regard to FIGS. 5–9, the platen assembly 26 includes a proximal portion 30 directly adjacent to the cutter assembly 24, and the proximal portion is provided with a plurality of closely spaced parallel channels 32, each channel being dimensioned and positioned to receive one strip as the strips are discharged from the cutter assembly 24. Each channel 32 is provided with a bottom surface that is sloped laterally with respect to the longitudinal extent of the channel, whereby each strip falls into its respective channel in an orientation tilted slightly from horizontal. When the strips are thus received from the cutter assembly, they are disposed in a parallel array that is too closely spaced (in the lateral direction) to be grasped, manipulated, or otherwise processed using automated equipment. (Likewise, it should be noted that the strips are too closely spaced to the processed by hand.)

The channels 32 are divided into two differing groups according to their construction and use, the groups being identified as 32T and 32A. The channels 32T and 32A are disposed in laterally adjacent alternating arrangement, so that every other one of the channels belongs to the same group. With regard to FIG. 5, the channels 32A are each provided with a pair of suction holes 33 extending to the bottom surface of the proximal portion of the channel. The suction holes, which serve to retain a strip in the channel 32A, communicate with a suction port 34 that is connected to a selectively operated vacuum source. With regard to FIG. 6, each channel 32T is provided with a pair of suction holes 36 extending to the bottom surface of the distal portion of the channel. The suction holes served to retain a strip in the distal portion of each channel 32T, and communicate with a suction port 37 that is connected to another selectively operated vacuum source. In addition, each channel 32T includes a longitudinally oriented slot 38 extending into the bottom surface of the proximal portion of the channel 32T. Each slot is sufficiently wide and deep to accommodate a tine of the comb device described below.

Figure 4:
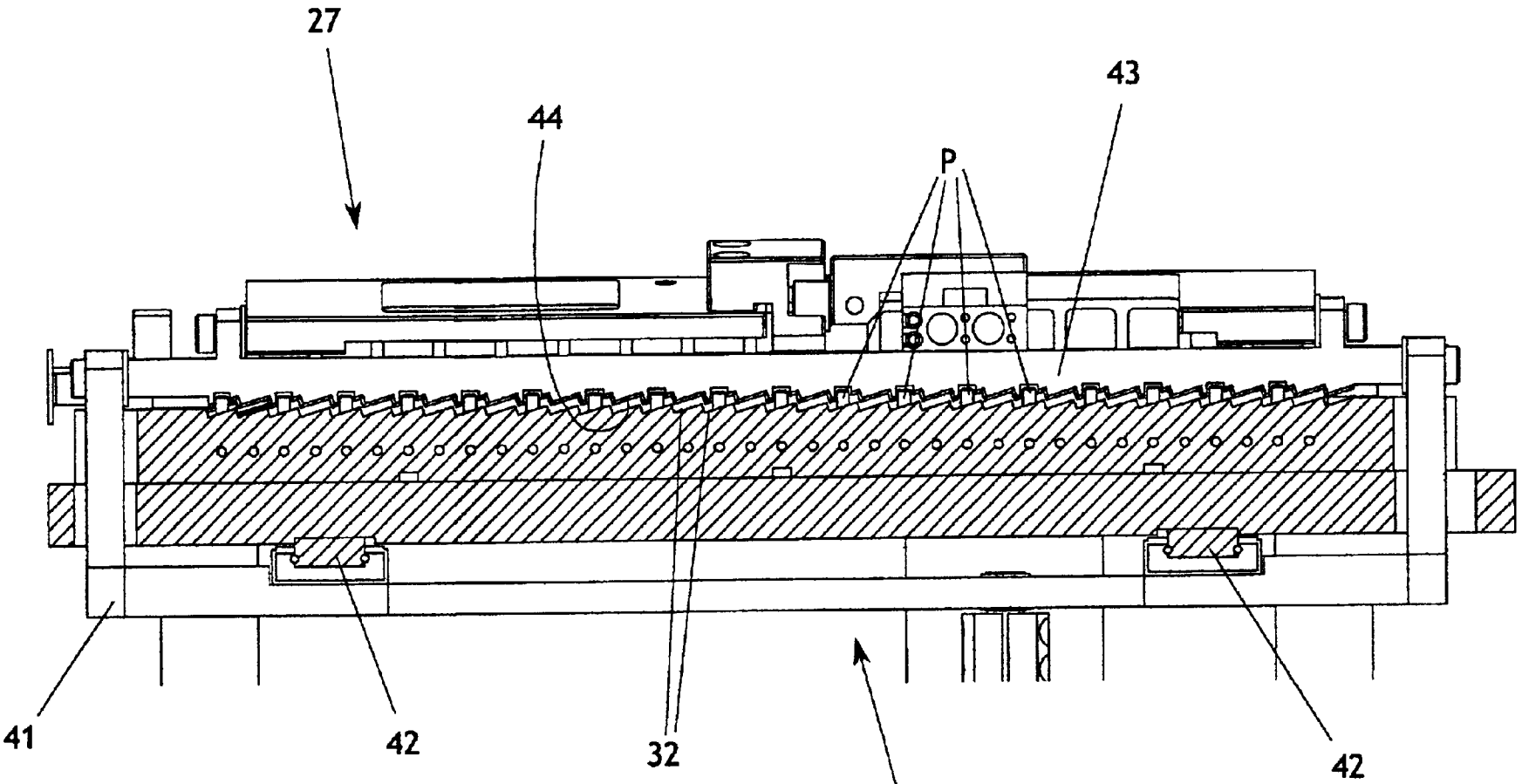
FIG. 4 is an enlarged cross-sectional end elevation showing the platen assembly and separator assembly.
Figure 5:
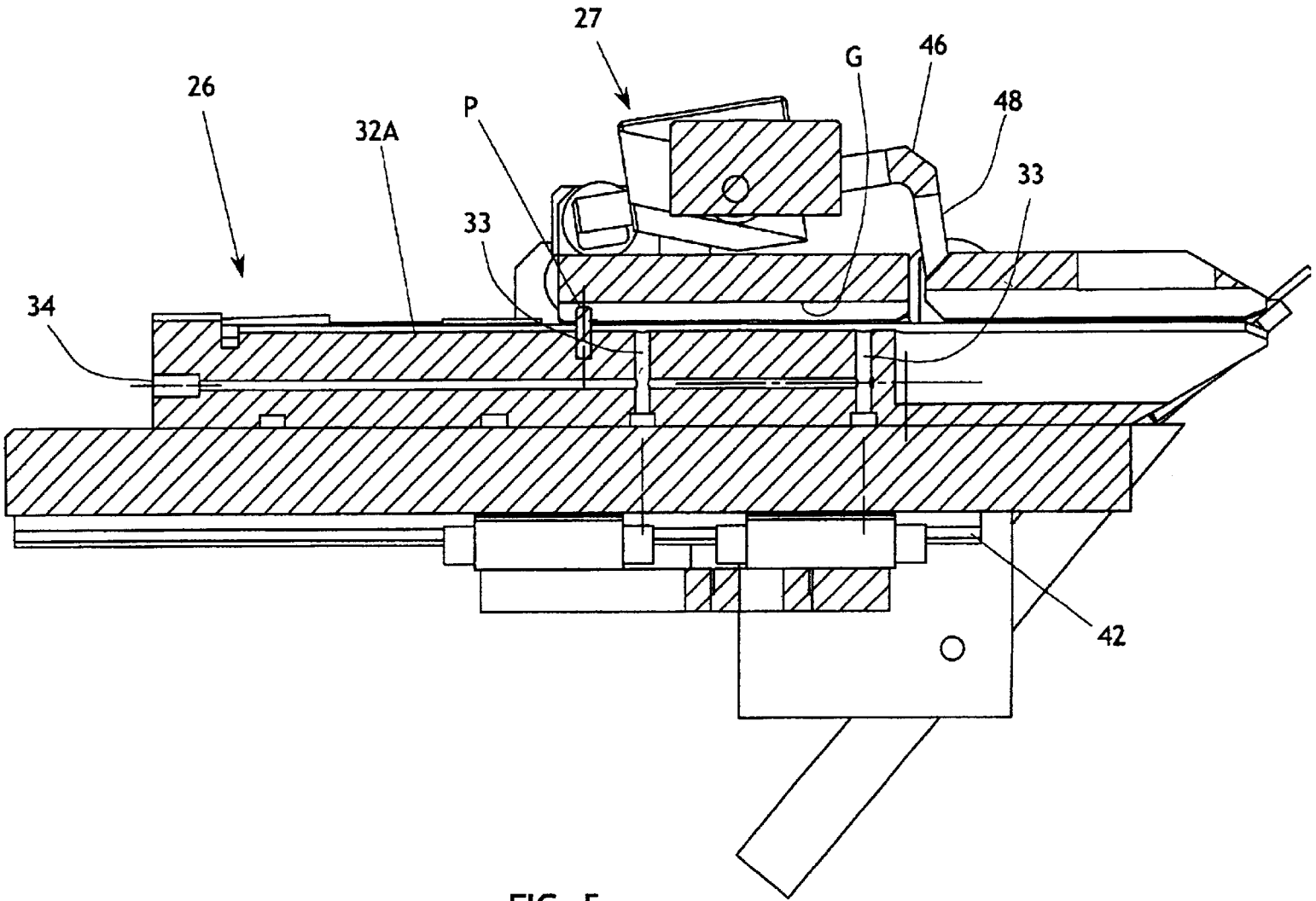
FIG. 5 is an enlarged cross-sectional side elevation showing the platen assembly and separator assembly.
Figure 6:
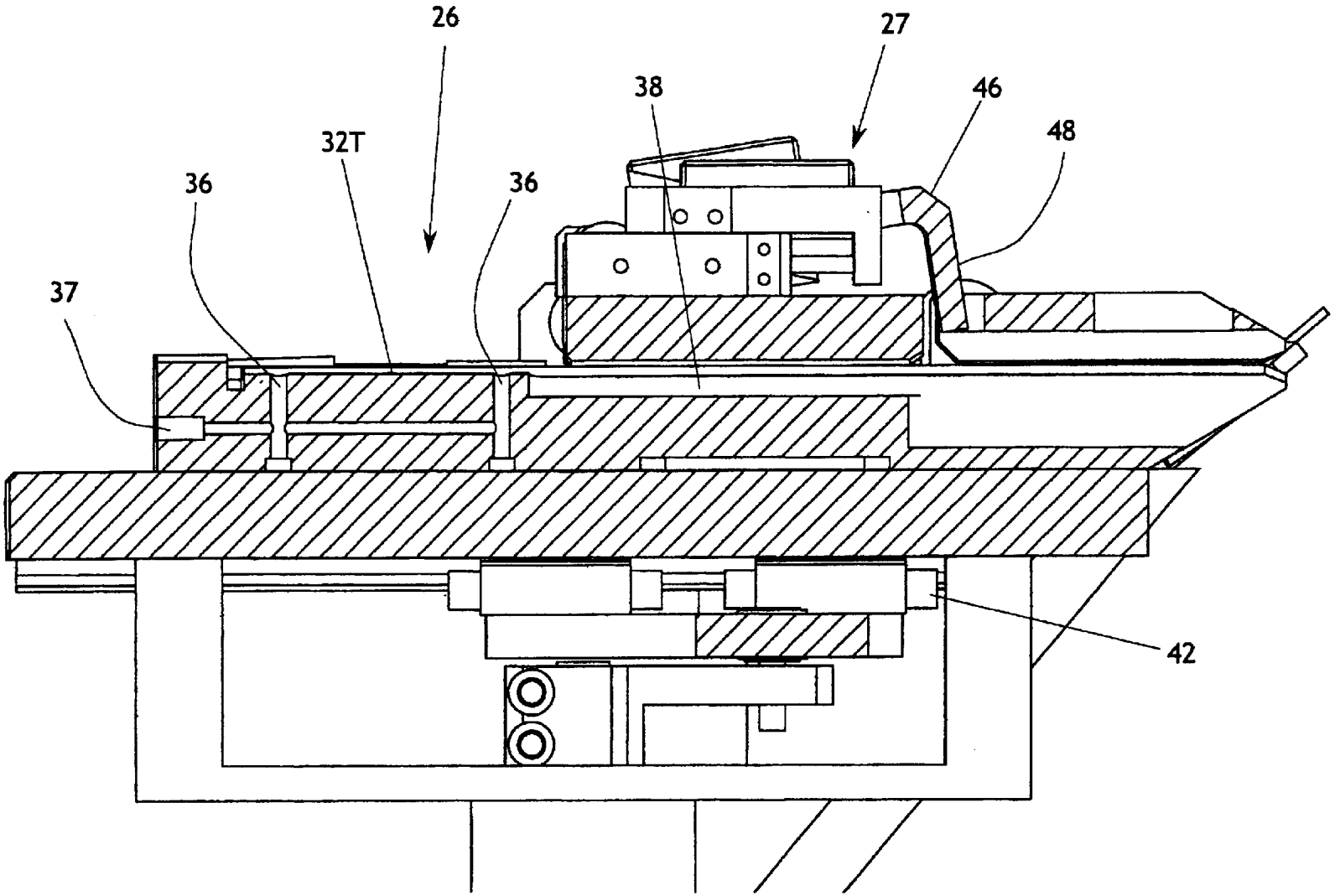
FIG. 6 is an enlarged cross-sectional side elevation showing the platen assembly and separator assembly.

The platen assembly 26 is engaged by the separator assembly 27. With regard to FIGS. 4–9, the separator assembly spans the lateral distance over all the channels 32, and is supported by a mechanism 41 that is designed to translate longitudinally on bearing slides 42 between the proximal and distal portions of the platen assembly 26. The separator assembly includes an upper containment plate 43 extending laterally superjacently to the channels 32. The upper containment plate is provided with a bottom surface 44 that spans and confronts the platen surface and is closely spaced thereabove. The surface 44 is formed in complementary fashion to the channels of the platen, as shown most clearly in FIG. 4, so that each channel is bounded at its top and sides to define a narrow capture zone that retains one strip in each channel and prevents movement of the strip in the channel in any direction except longitudinally. A plurality of pins P extend from the distal ends of the bottom surfaces of each channel 32A. The pins P act as a stop to prevent strips 50A from being dragged in the distal direction as the upper containment plate 43 is moved distally. Although the suction under the strips is generally sufficient, the adhesives used in the lamination-assembly of some cards may migrate to the surfaces of the mechanism, causing it to drag on strips and retard their movement. There is a groove G in the underside of the containment plate 43 at the location of each pin P to allow the plate to slide over the pins.

Figure 7:
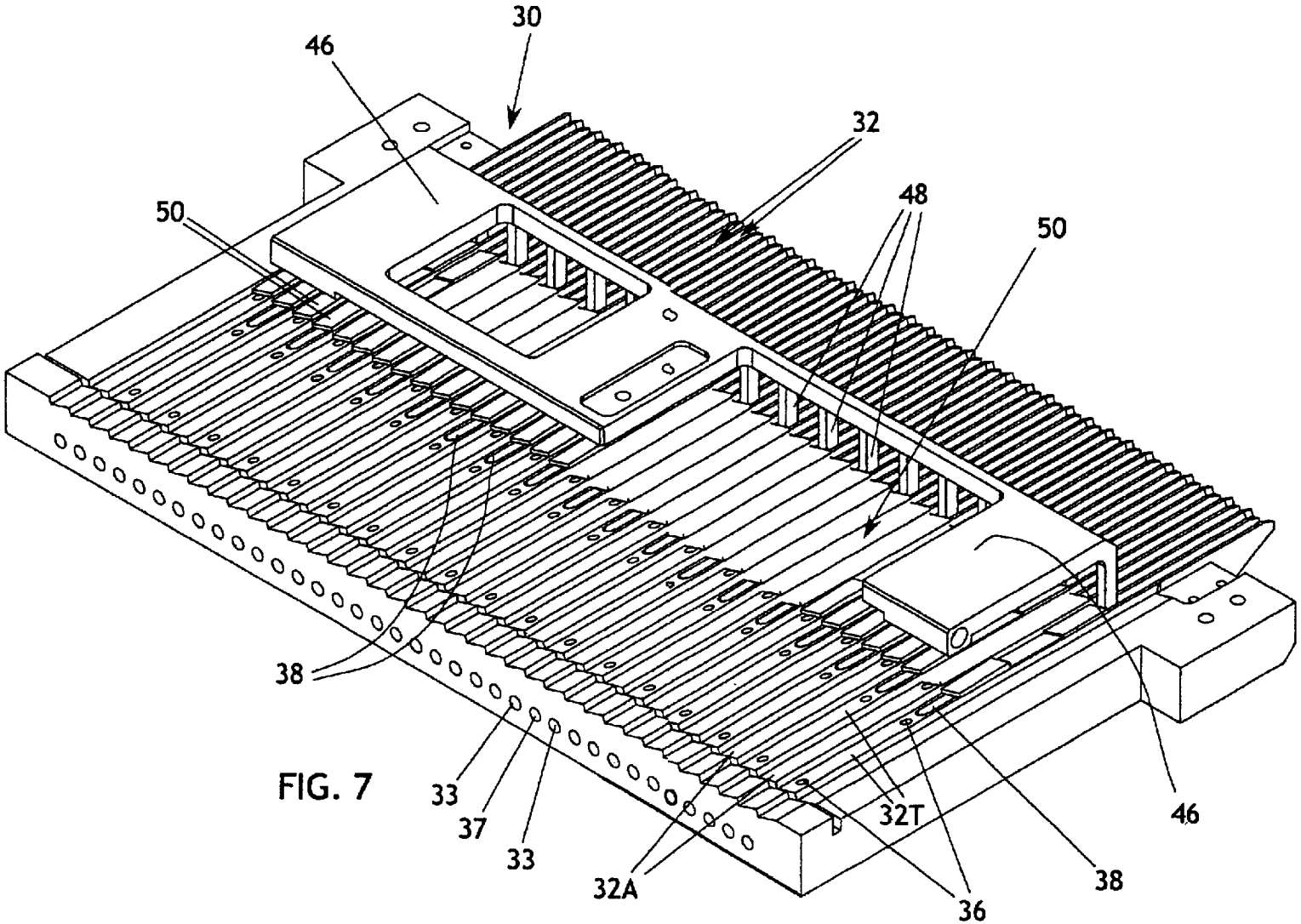
FIG. 7 is an enlarged perspective view of the platen assembly, with the separator assembly translated to the proximal portion of the platen assembly and the comb device rotated to the lower position, each channel of the platen assembly holding a respective strip in a closely spaced, parallel array.

The separator assembly further includes a comb device 46 that extends laterally across the platen and is pivotally secured to the separator assembly by hinges 47 that are aligned laterally above the platen assembly. The comb device includes a plurality of tines 48 (see FIG. 9) extending from the proximal edge thereof toward the platen assembly, each tine 48 being aligned and dimensioned to be received in one of the channels 32T. An actuator mechanism 49 is linked to the comb device to selectively rotate the comb device from an upper position in which the tines 48 are clear of the channels 32T (FIG. 9), to a lower position in which the tines 48 are engaged in the channels 32T (FIG. 7). As noted previously, the tines 48 are dimensioned to be slidably received in respective slots 38 of the channels 32T, so that the tines may be employed to push the strips longitudinally and distally in channels 32T, as will be explained below.

The separator assembly is operated upon command to reiterate the steps of a cycle, as follows. The separator assembly 27 is translated along guides 42 to the proximal portion of the platen assembly. The comb device 47 is rotated to the upper position so that the tines 48 are clear of the channels 32T. The cutter assembly is then operated to advance a card and slice it into a plurality of thin strips 50 in closely spaced parallel array, each strip being received in one of the channels 32, as shown best in FIG. 7 with the upper containment plate removed. The comb device is then rotated to the lower position, the tines extending into the slots 38 adjacent to the proximal ends of the respective strip in each slot 32T vacuum is applied to the vacuum ports 34 to secure the strips 50A that are disposed in the proximal portions of channels 32A.

Figure 8:
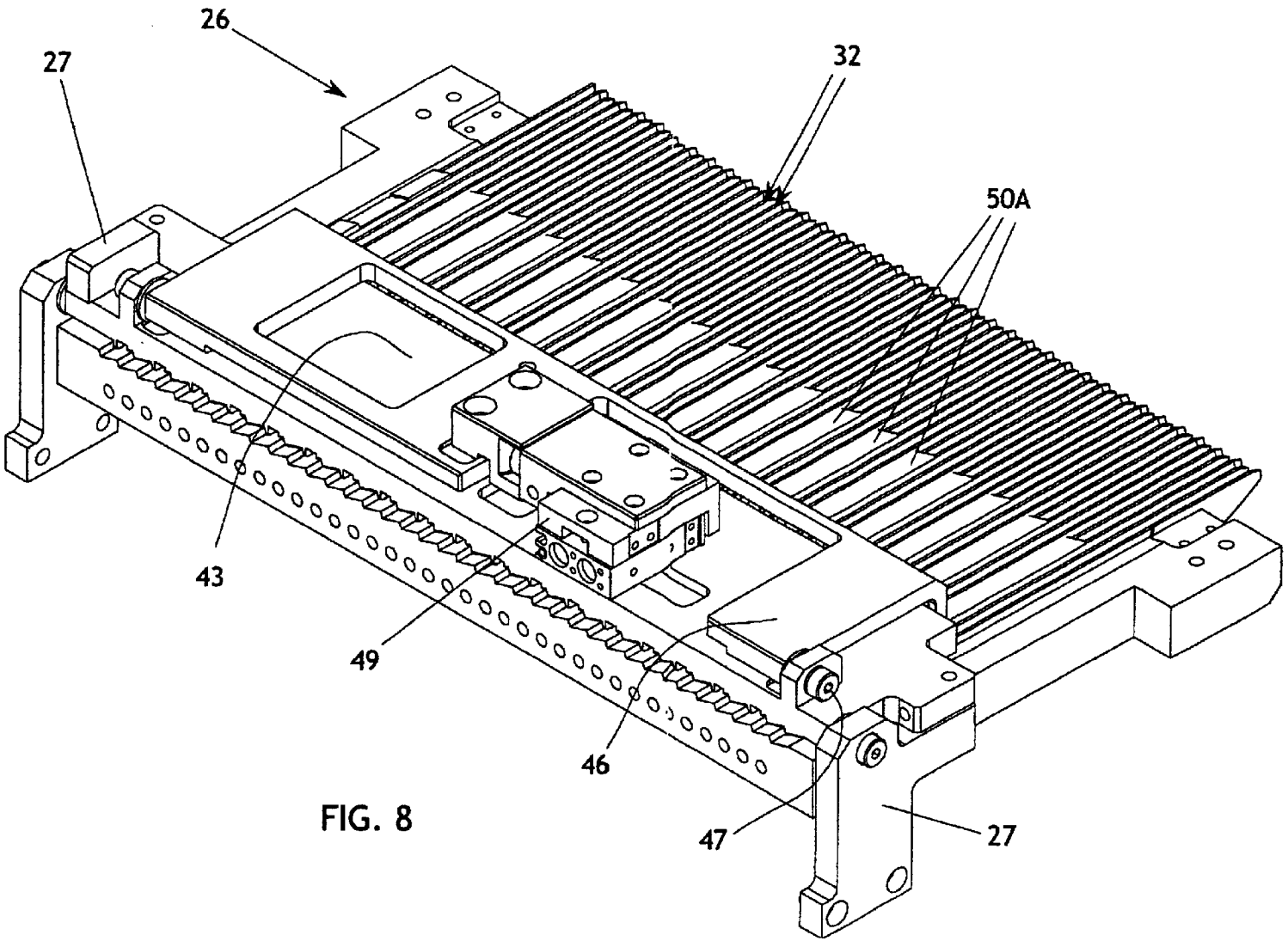
FIG. 8 is an enlarged perspective view of the platen assembly, with the separator assembly translated to the distal position, and the proximal group of strips disposed in parallel, spaced apart fashion.
Figure 9:
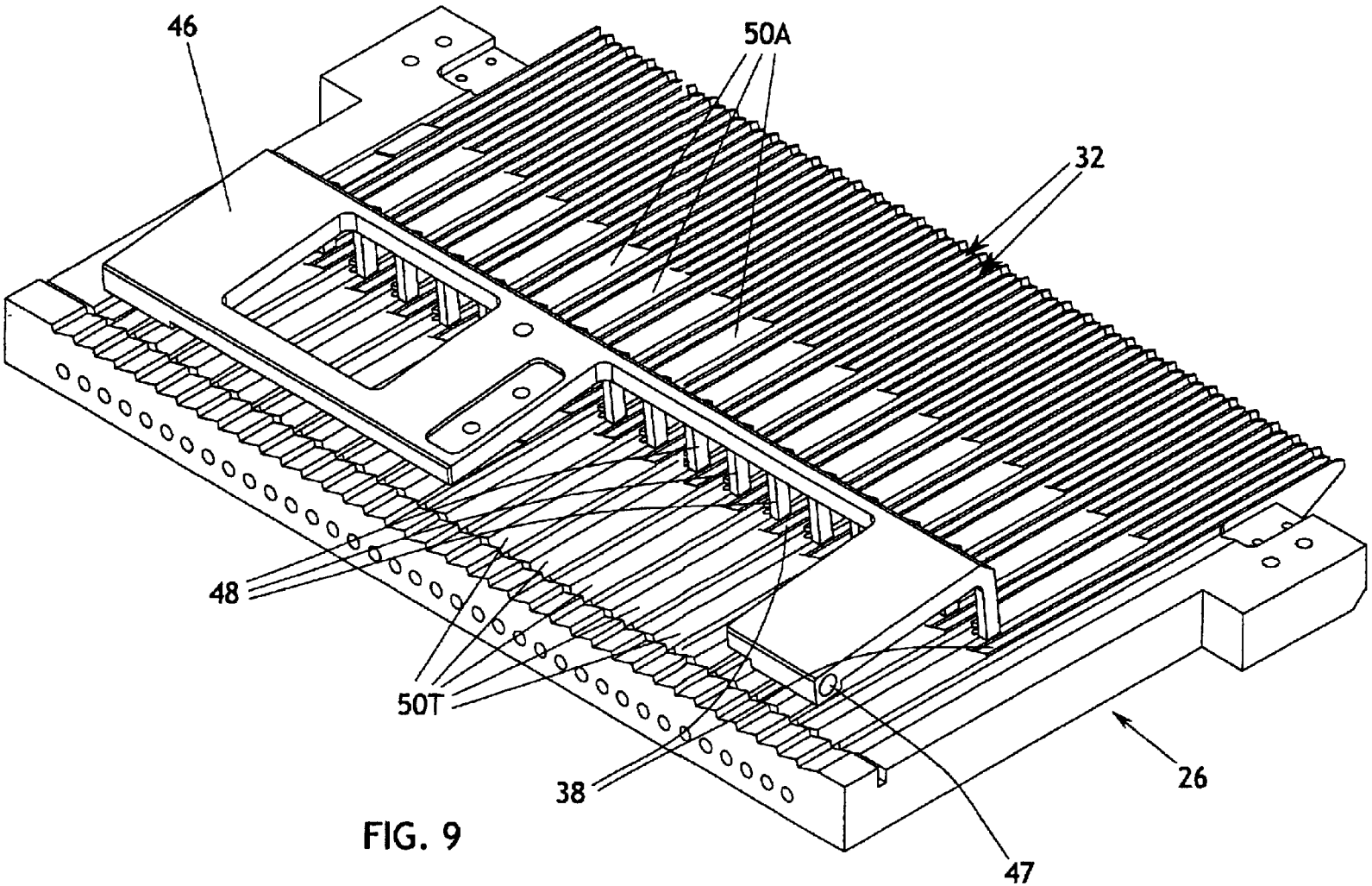
FIG. 9 is an enlarged perspective view as in FIGS. 7 and 8, with the separator assembly disposed at the distal position and the comb rotated to the upward position.

The separator assembly is then translated distally, the tines 48 pushing the strips 50T in slots 32T to the distal portions thereof, as shown in FIG. 8. Note that the translating strips remain contained by the upper containment plate 43, and cannot be pushed out of their respective channels. This action separates the two groups 50A and SOT in the longitudinal direction, each group having individual strips spaced apart a distance equal to approximately the width of one channel 32, as shown in FIG. 9. The group of strips 50A is exposed upwardly to be accessed for transferal, as will be described below, and the strips 50T are retained between the upper containment plate 43 and the platen. After the strips 50A are removed from the platen assembly, the comb device is rotated to the upper position, vacuum is applied to the suction port 37 to secure the strips 50T in the distal portions of channels 32T, and the separator assembly is translated to the proximal position to allow the pickup of strips 50T in exactly the same manner. The platen assembly is then ready to receive another delivery of strips 50 from the cutter assembly.

Another major assembly of the invention, the pick-and-place conveyor 29, is adapted to transfer strips from the platen assembly 26 to the belt conveyor 31. With regard to FIGS. 3, and 10–14, the pick-and-place conveyor 29 includes a carriage 61 adapted to translate reciprocally and selectively along a track 62 that extends generally longitudinally and superjacently of the platen assembly. The carriage includes a drive system 63 to move the carriage along the track to selected positions with highly accurate placement. Also extending from the carriage is a pickup arm 64that is mounted on a linear actuator mechanism 66 for reciprocal translational movement along an axis extending slightly obliquely to vertical. The axis of motion is generally parallel to a line normal to the angle of the bottom surfaces of the channels 32.

A pickup head 28 extending downwardly from the lower end of the arm 64 is provided with a plurality of suction cups 67 supported in a rack 68 and disposed in twin linear arrays 69, each suction cup of one linear array being paired with it respective counterpart in the other linear array. The suction cups are connected (not shown) either individually or by manifold to a selectively actuated vacuum source. The suction cups of each pair are spaced apart sufficiently to engage opposed ends of one strip 50. The number of pairs of suction cups is generally equal to the number of strips in the groups 50A and 50T. Each suction cup is spaced apart from its adjacent suction cups in the linear array by a distance generally equal to the width of one channel 32, which is the spacing of the strips 50A or 50T. Note that all the suction cups extend generally to the same plane, but the faces of the suction cups are also generally parallel to the bottom surfaces of the channels 32. The layout of the suction cup array is designed to enable the suction cups to align with, grasp (via suction) all the strips in the groups 50A or 50T, and lift, transport, and place the strips on the belt conveyor 31.

The pick-and-place conveyor 29 is driven reciprocally between a position superjacent to a belt conveyor 31, and, alternately, superjacent to the proximal and distal portions of the platen assembly. The pick-and-place conveyor is actuated in synchronism with the separator assembly and the cutter assembly.

Figure 10:
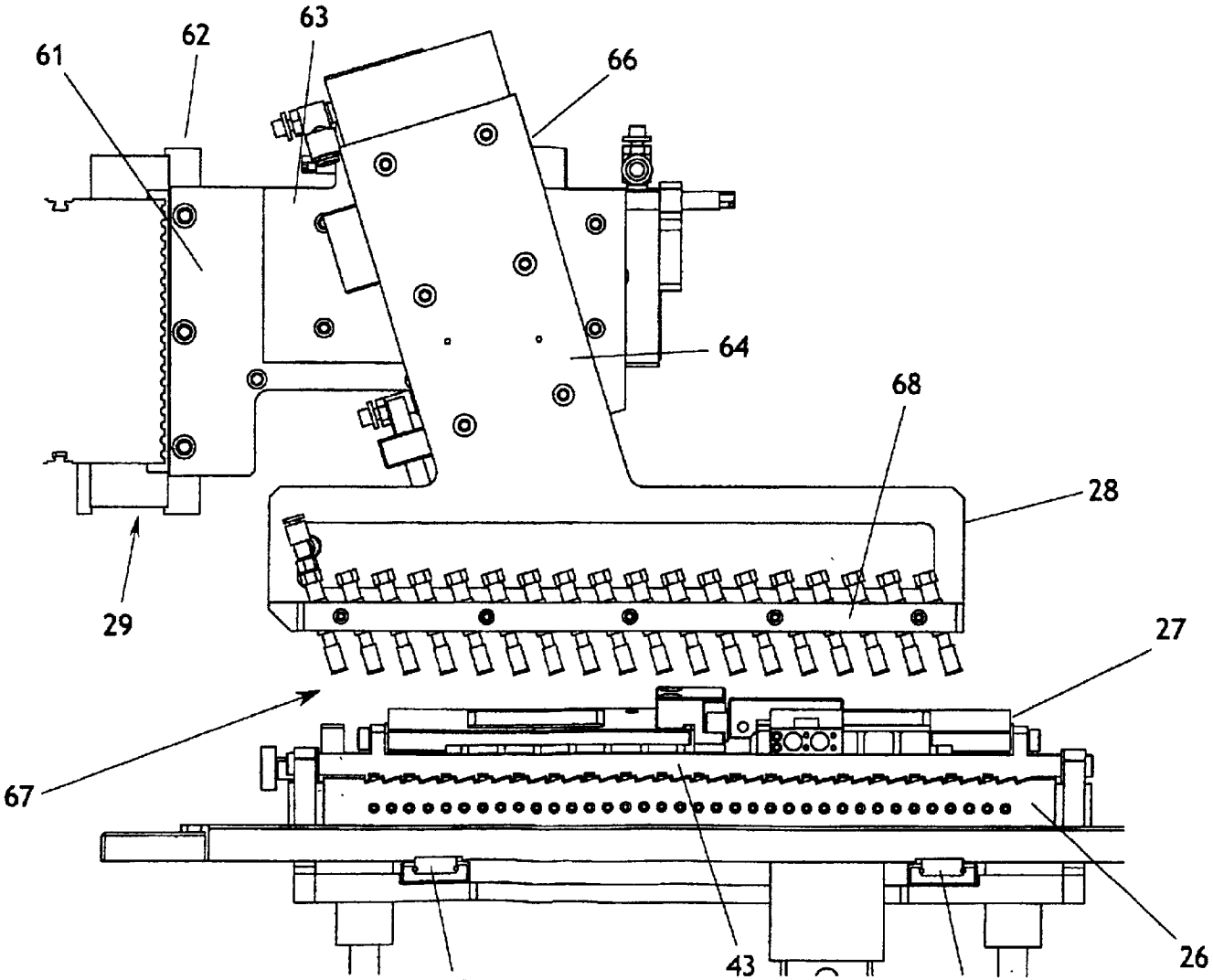
FIG. 10 is a front elevation of the platen assembly with the pick-and-place conveyor shown above the platen assembly.
Figure 11:
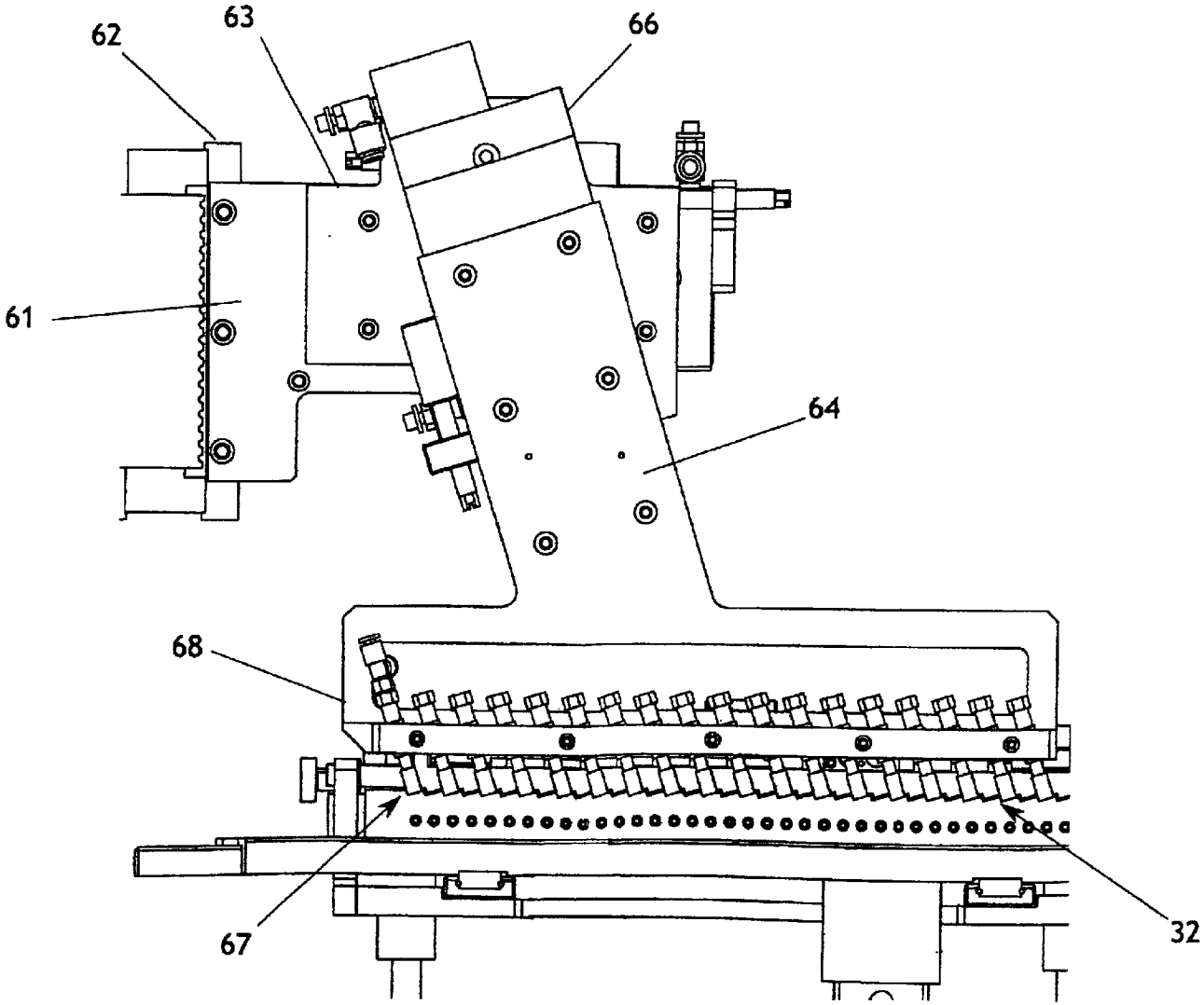
FIG. 11 is a front elevation as in FIG. 10, showing the pick-and-place conveyor engaged with the platen assembly.
Figure 12:
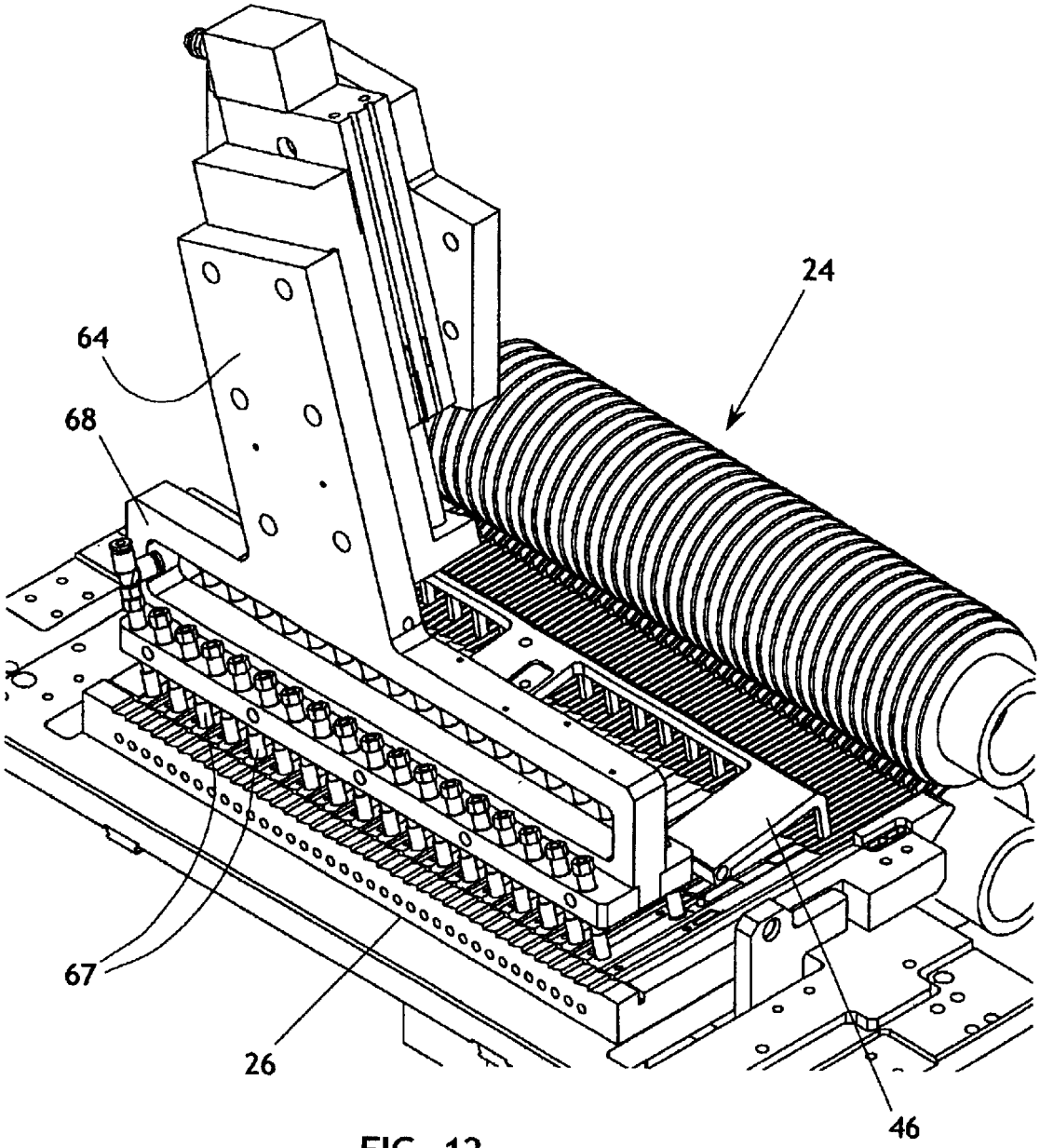
FIG. 12 is a perspective view showing the pick-and-place conveyor engaged with the distal portion of the platen assembly.

In general, the various assemblies and mechanisms of the invention operate according to the following sequential steps to achieve the goal of increasing the spacing of the lightweight strips so that the strips may be accessed and engaged by further processing equipment. As described previously, the separator assembly 27 translates reciprocally between the proximal and distal portions of the platen assembly 26, receiving at the proximal portion a fresh batch of strips from the cutter assembly 24, and separating the strips into two groups; 50A at the proximal portion, and 50T at the distal portion of the platen. When the separator assembly is disposed at the proximal portion of the platen, the group of strips 50T at the distal portion is exposed upwardly for access by the pick-and-place conveyor 29. The carriage 61 traverses to a position superjacent to the proximal portion of the platen, with the pickup head 28 disposed in an upwardly retracted disposition, as shown in FIG. 10. The pickup arm 64 translates downwardly, and the suction cups 67 descend at an angle and orientation to engage the strips in flush relationship, as shown in FIG. 11. Each pair of suction cups engages one of the strips 50T (FIG. 12), as the vacuum source to the suction cups is turned on, while the vacuum source to the ports 37 is turned off to release the suction effect on the strips from the channels 32T. The strips are thus grasped by the suction cups, and the arm 64 then translates upwardly to remove the strips 50T from the platen.

Figure 3:
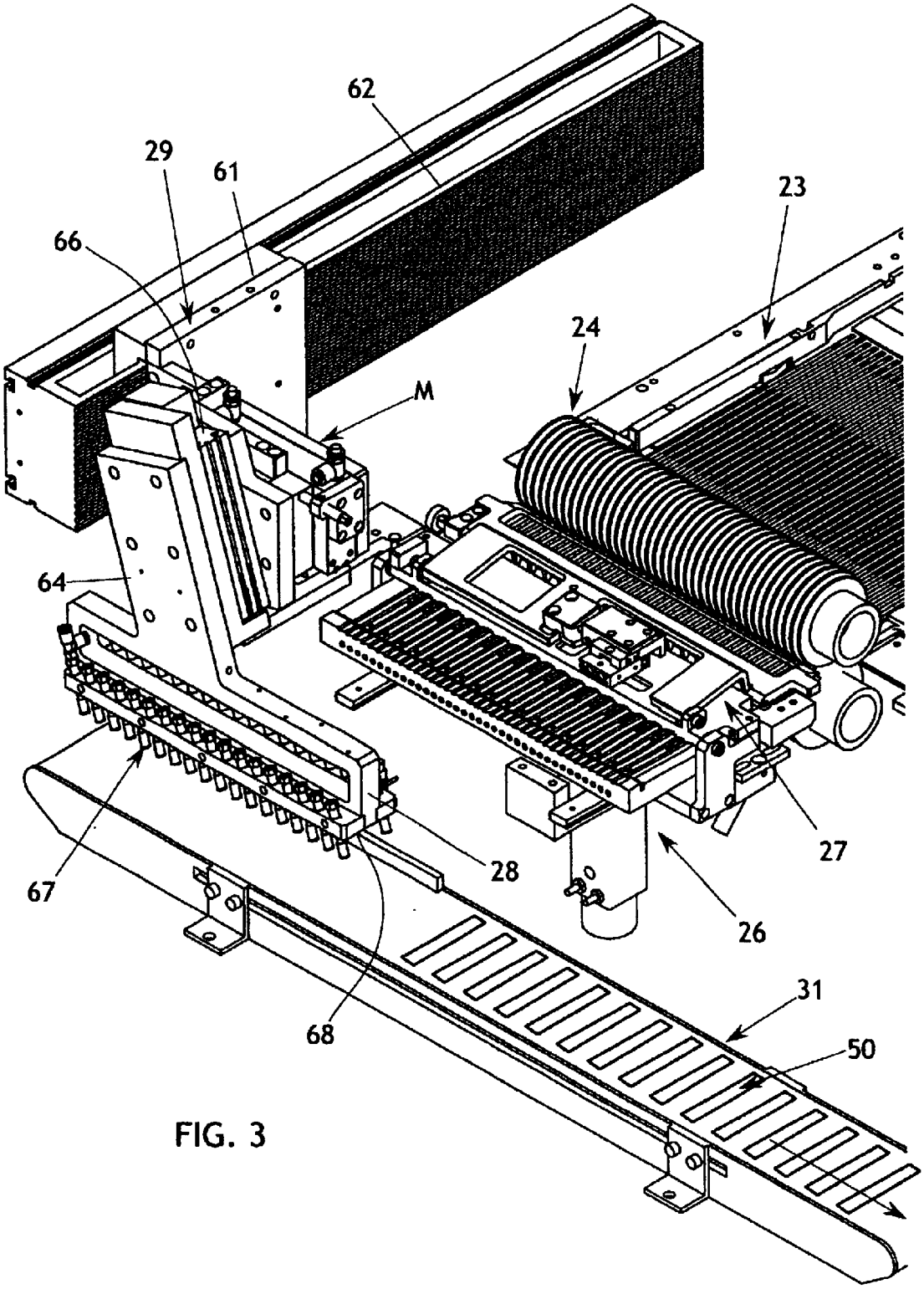
FIG. 3 is a perspective view of the apparatus generally depicted in FIGS. 1 and 2.

Thereafter the carriage 61 translates along guide rail 62 to a position above the belt conveyor 31, as shown in FIG. 3. The arm 64 descends so that the strips 50T in the grasp of the pickup head 28 are impinged on the belt conveyor. The vacuum supply to the suction cups is turned off, and the strips are released onto the belt conveyor.

Figure 13:
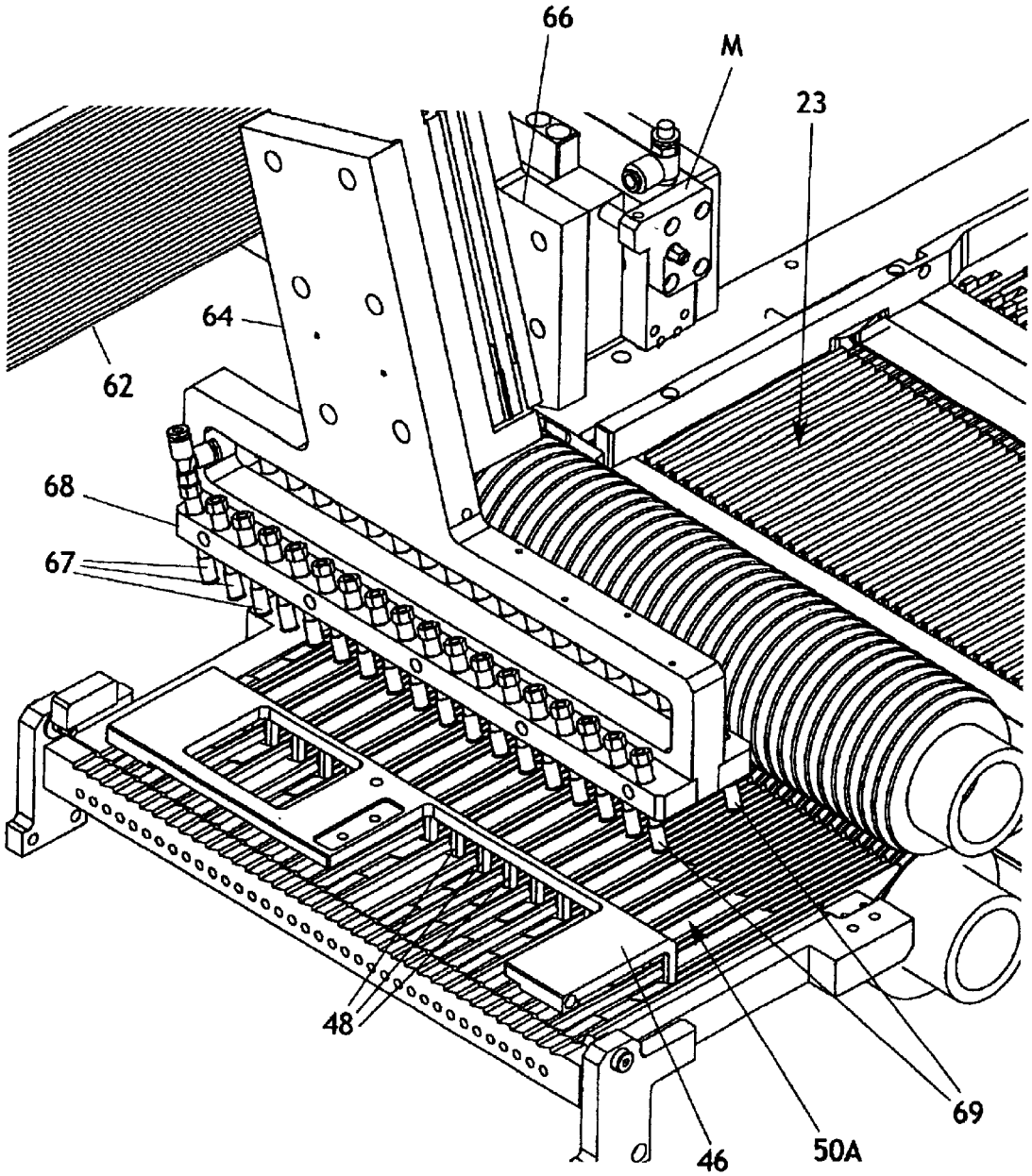
FIG. 13 is a perspective view showing the pick-and-place conveyor disposed above the proximal portion of the platen assembly.
Figure 14:
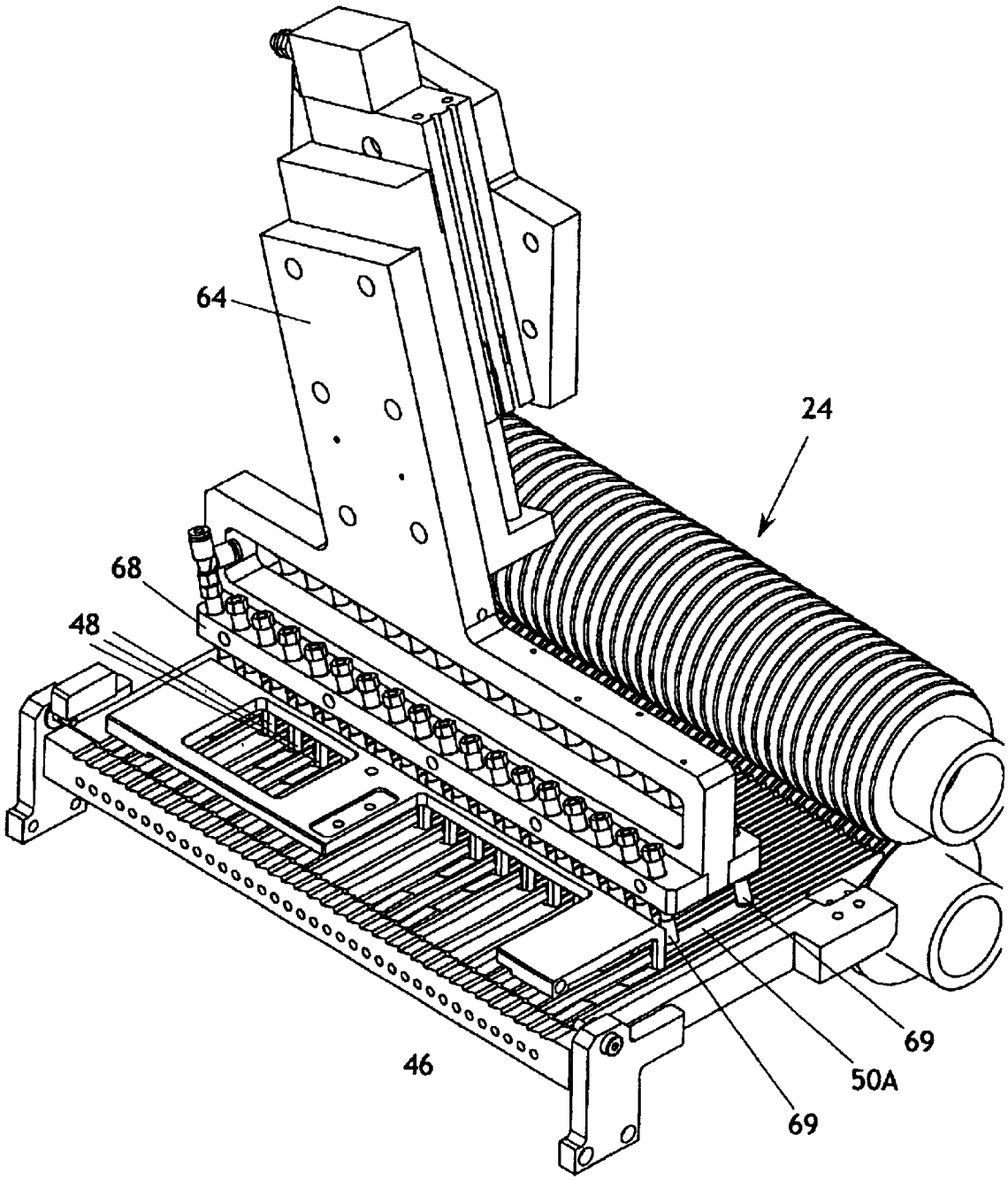
FIG. 14 is a perspective view showing the pick-and-place conveyor engaged with the proximal portion of the platen assembly.

Meanwhile the separator assembly has traveled distally on the platen to separate the batch of strips into the groups 50T and 50A (FIG. 8). The group 50A at the proximal portion of the platen is thus exposed upwardly to access by the pick-and-place conveyor 29. The carriage 61 translates (FIG. 10) to a position above the proximal platen, and the head prepares to descend, as shown in FIG. 13. The mechanism M is a linear actuator that permit the head to index laterally a distance equal to the width of one channel 32, so that the group 50A, which is staggered by a factor of one channel width from the group 50T, may be engaged by the suction cup array 67. That is, actuator M translates the head 64 laterally to facilitate the pickup from channels A and T, alternately. The head then descends, as indicated in FIG. 11, and the suction cup array engages the group of strips 50A, as shown in FIG. 14, while the suction to ports 34 is turned off to release the suction grip of the channels 32A. The head 28 is retracted vertically to lift the strips 50A from the platen, and the conveyor 29 translates back to the belt conveyor. Meanwhile the separator assembly travels proximally, exposing another group of strips 50T to access by the conveyor 29. Note that the pickup head indexes laterally in reciprocating fashion each time that it translates to the proximal or distal portions of the platen assembly. This cycle may reiterate indefinitely, converting groups of strips from the cutter assembly that have virtually no lateral spacing, into a continuous stream of strips that are spaced apart sufficiently on the belt conveyor to be processed by further automated devices positioned downstream on the belt conveyor.

It should be noted that the pick-and-place conveyor may be operated to deposit the groups of strips in laterally spaced apart format onto other strip utilizing devices, rather than the belt conveyor shown and described herein.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. An apparatus for processing groups of lightweight strips in parallel, lateral edge-adjacent array into a spaced apart arrangement suitable for processing, comprising:

platen means for receiving a plurality of strips from a cutter assembly in edge-adjacent array;

separator means for separating said plurality of strips into groups, each group of strips having lateral spacing between adjacent strips therein, said groups being disposed in a mutual plane on said platen means;

pick-and-place means for grasping each of said groups of strips and placing each of said group of strips in a laterally spaced parallel array.

2. The apparatus of claim 1, wherein said platen means includes a platen having a plurality of parallel adjacent channels, each of said channels disposed to receive one of said lightweight strips from a cutter assembly.

3. The apparatus of claim 2, wherein said platen includes proximal and distal portions, and said plurality of strips are deposited by the cutter assembly on said proximal portion of said platen.

4. The apparatus of claim 3, wherein said separator means includes a separator assembly, said separator assembly disposed generally superjacently of said platen and arranged to translate reciprocally between said proximal and distal portions of said platen.

5. The apparatus of claim 4, wherein said separator assembly includes comb means for dividing said plurality of strips into said groups, said comb means including a plurality of tines arrayed and dimensioned to be received in every other channel of said platen.

6. The apparatus of claim 5, wherein said comb means is disposed to push the strips in said every other channel from said proximal portion to said distal portion of said platen, whereby separate proximal and distal groups of strips are formed, each of said groups having strips that are laterally spaced apart.

7. The apparatus of claim 6, further including distal suction means in the distal portions of said every other channel to selectively secure said distal group of strips in said every other channel.

8. The apparatus of claim 7, wherein said pick-and-place means includes a pick-and-place conveyor disposed generally superjacently to said platen.

9. The apparatus of claim 8, wherein said pick-and-place conveyor includes suction cup means for grasping said strips in said proximal and distal groups of strips.

10. The apparatus of claim 9, wherein said suction cup means includes a plurality of suction cups arrayed in pairs, each pair of suction cups being disposed to engage one of said strips in one of said groups of strips.

11. The apparatus of claim 10, wherein said suction cups are arrayed to engage and grasp all of the strips in one of said groups of strips.

12. The apparatus of claim 9, wherein said suction cup means is mounted on a pickup head, and said pick-and-place conveyor includes means for translating said pickup head vertically to remove each of said proximal and distal groups of strips from said platen in alternating, reiterative fashion.

13. The apparatus of claim 12, wherein said pick-and-place conveyor includes means for translating said pickup head to a belt conveyor, and means for depositing each of said groups of strips onto said belt conveyor.

14. The apparatus of claim 13, wherein said pick-and-place conveyor includes means for reiteratively indexing said pickup head laterally a distance generally equal to the width of one of said channels.

15. The apparatus of claim 2, wherein said plurality of channels are divided into first and second subgroups of channels, each channel of said first subgroup disposed between two channels of said second subgroup in interdigitated fashion.

16. The apparatus of claim 15, wherein said second subgroup of channels includes second suction means for selectively securing one of said strips in each of said second subgroup of channels.

17. The apparatus of claim 16, wherein said second suction means is operatively associated with proximal portions of said second subgroup of channels.

18. The apparatus of claim 5, wherein said every other channel includes a slot in a bottom surface thereof, said slot being dimensioned to receive a respective one of said tines in freely sliding fashion.

19. The apparatus of claim 4, wherein said channels include bottom surfaces, each of said bottom surface sloped laterally and disposed parallel to a common plane.

20. The apparatus of claim 4, wherein said separator assembly includes a top containment plate, said top containment plate including a containment surface that is disposed in confronting relationship to said platen.

21. The apparatus of claim 20, wherein said containment surface is formed in complementary fashion to said channels and said bottom surfaces thereof, said containment surface being spaced vertically from said platen to define therewith a capture zone for the strips delivered from the cutter assembly.

22. A method for processing groups of lightweight strips in parallel, lateral edge-adjacent array into a spaced apart arrangement suitable for processing, comprising the steps of:

providing a platen having channels for receiving the strips in parallel, lateral edge-adjacent array, each strip received in on channel;

providing a comb having tines extendable into every other channel;

translating said comb longitudinally with respect to the channels to divide the strips into two groups, each group comprised of strips that are laterally spaced apart; and, removing each group of strips from the platen while maintaining the laterally spaced apart disposition.

23. The method of claim 22, wherein said removing step includes providing a pick-and-place conveyor having suction means for grasping and removing each group of strips in unison.

24. The method of claim 22, further including the step of providing suction means to selectively secure said groups of strips in their respective channels of said platen.

25. An apparatus for processing groups of lightweight strips in parallel, lateral edge-adjacent array into a spaced apart arrangement suitable for processing, comprising:

platen means for receiving a plurality of strips from a cutter assembly in edge-adjacent array;

separator means for separating said plurality of strips into groups, each group of strips having lateral spacing between adjacent strips therein;

pick-and-place means for grasping each of said groups of strips and placing each of said group of strips in a laterally spaced parallel array;

said platen means including a platen having a plurality of parallel adjacent channels, each of said channels disposed to receive one of said lightweight strips from a cutter assembly;

said platen including proximal and distal portions, said plurality of strips being deposited by the cutter assembly on said proximal portion of said platen;

said separator means including a separator assembly, said separator assembly disposed generally superjacently of said platen and arranged to translate reciprocally between said proximal and distal portions of said platen.

* * * * *